US009353330B2

(12) United States Patent
Gregory

(10) Patent No.: US 9,353,330 B2
(45) Date of Patent: May 31, 2016

(54) MARINE ENGINE LUBRICATION

(71) Applicant: Infineum International Limited, Abingdon (GB)

(72) Inventor: Laura Gregory, Wilts (GB)

(73) Assignee: INFINEUM INTERNATIONAL LIMITED (GB)

( * ) Notice: Subject to any disclaimer, the term of this patent is extended or adjusted under 35 U.S.C. 154(b) by 0 days.

(21) Appl. No.: 14/494,620

(22) Filed: Sep. 24, 2014

(65) Prior Publication Data

US 2015/0083067 A1 Mar. 26, 2015

(30) Foreign Application Priority Data

Sep. 24, 2013 (EP) ..... 13185713

(51) Int. Cl.

| | |
|---|---|
| ***C10M 169/04*** | (2006.01) |
| ***C10M 133/00*** | (2006.01) |
| ***F02B 43/00*** | (2006.01) |
| ***F02B 47/00*** | (2006.01) |
| ***F02M 25/00*** | (2006.01) |
| ***C10M 161/00*** | (2006.01) |
| ***C10M 163/00*** | (2006.01) |

(52) U.S. Cl.

CPC ..... *C10M 161/00* (2013.01); *C10M 163/00* (2013.01); *C10M 2203/1006* (2013.01); *C10M 2203/1025* (2013.01); *C10M 2205/0285* (2013.01); *C10M 2207/023* (2013.01); *C10M 2207/129* (2013.01); *C10M 2207/262* (2013.01); *C10N 2220/027* (2013.01); *C10N 2230/04* (2013.01); *C10N 2240/102* (2013.01)

(58) Field of Classification Search

CPC ..... C10M 2207/129; C10M 2207/40
USPC ..... 508/306, 314; 123/1 A
See application file for complete search history.

(56) References Cited

U.S. PATENT DOCUMENTS

| | | | | |
|---|---|---|---|---|
| 6,521,571 | B1 * | 2/2003 | Garner | C10M 163/00 508/354 |
| 2012/0028521 | A1 * | 2/2012 | Garner | C10M 169/045 440/88 L |
| 2012/0103303 | A1 * | 5/2012 | Hartley | C10M 129/10 123/27 R |

* cited by examiner

*Primary Examiner* — Vishal Vasisth

(57) ABSTRACT

A trunk piston lubricating oil composition of TBN 20 to 60 comprising (A) a high saturates low sulphur oil of lubricating viscosity in a major amount; (B) an overbased metal hydroxybenzoate detergent additive; (C) a polyisobutene succinic anhydride additive (1-7 mass %); and (D) a meta-linear pentadecyl phenol additive (10.1 to 10 mass %), the weight ratio of (D) to (C) being less than 1 and the combined treat rate of (B), (C) and (D) being 5 to 30%. The composition is useful to improve asphaltene dispersancy when lubricating a medium-speed compression-ignited marine engine fueled by a heavy fuel oil.

14 Claims, No Drawings

MARINE ENGINE LUBRICATION

FIELD OF THE INVENTION

This invention relates to trunk piston marine engine lubrication for a medium-speed four-stroke compression-ignited (diesel) marine engine.

BACKGROUND OF THE INVENTION

Marine trunk piston engines generally use Heavy Fuel Oil ('HFO') for offshore running. Heavy Fuel Oil is the heaviest fraction of petroleum distillate and comprises a complex mixture of molecules including up to 15% of asphaltenes, defined as the fraction of petroleum distillate that is insoluble in an excess of aliphatic hydrocarbon (e.g. heptane) but which is soluble in aromatic solvents (e.g. toluene). Asphaltenes can enter the engine lubricant as contaminants either via the cylinder or the fuel pumps and injectors, and asphaltene precipitation can then occur, manifested in 'black paint' or 'black sludge' in the engine. The presence of such carbonaceous deposits on a piston surface can act as an insulating layer which can result in the formation of cracks that then propagate through the piston. If a crack travels through the piston, hot combustion gases can enter the crankcase, possibly resulting in a crankcase explosion.

It is therefore highly desirable that trunk piston engine oils ('TPEO's) prevent or inhibit asphaltene precipitation, a problem which becomes more acute when the oil of lubricating viscosity has a higher saturates content. The prior art describes ways of doing this, including use of metal carboxylate detergents. See for example, WO 2008/128656, WO 2010/115594 and WO 2010/115595.

The art does not, however, concern itself with the influence of combinations of certain anhydrides and phenols as additives on the problem of asphaltene precipitation at higher saturate levels in the oil of lubricating viscosity in a TPEO.

SUMMARY OF THE INVENTION

It is now surprisingly found that, when a polyalkenyl carboxylic acid anhydride additive is used in combination with a phenolic additive in a defined ratio, a TPEO made therefrom and that includes a hydroxybenzoate detergent additive, has improved asphaltene dispersancy performance when the oil of lubricating viscosity in the TPEO is a high saturates content oil.

Thus, a first aspect of the invention is a trunk piston marine engine lubricating oil composition of TBN 20 to 60 for a medium-speed four-stroke compression-ignited marine engine, comprising or made by admixing:

(A) an oil of lubricating viscosity in a major amount comprising a basestock containing greater than or equal to 90% saturates and less than or equal to 0.03% sulphur;

(B) a detergent additive, in a minor amount, comprising one or more overbased metal hydrocarbyl-substituted hydroxybenzoates;

(C) an additive, in an amount of 0.1 to 10 mass %, preferably of 0.5 to 7 mass %, more preferably of 1 to 7 mass %, comprising one or more polyisobutene succinic anhydrides, the polyisobutene having a number average molecular weight of 200 to 3000; and (D) an additive, in an amount of 0.1 to 10 mass %, preferably of 0.1 to 9.9 mass %, more preferably of 0.1 to 6.9 mass %, comprising one or more sterically unhindered meta linear pentadecyl phenols, the weight ratio of (D) to (C) being less than 1, preferably in the range of 0.2 to 0.6, more preferably 0.25 to 0.5; and the combined treat rate of said hydroxybenzoate(s), anhydride(s) and phenol(s) being in the range of 5 to 30, preferably 5 to 25, mass %.

The trunk piston marine engine lubricating oil composition has a TBN 20 to 60, and comprises, or is made by admixing:

(A) an oil of lubricating viscosity in a major amount comprising a basestock containing greater than or equal to 90% saturates and less than or equal to 0.03% sulphur;

(B) a detergent additive comprising one or more overbased metal hydrocarbyl-substituted hydroxybenzoates;

(C) from 0.1 to 7 mass %, preferably from 0.5 to 7 mass %, more preferably from 1 to 7 mass %, of one or more polyisobutene succinic anhydrides, the polyisobutene having a number average molecular weight of 200 to 3000; and (D) from 0.1 to 10 mass %, preferably from 0.1 to 9.9 mass %, more preferably from 0.1 to 6.9 mass %, of one or more sterically unhindered meta linear pentadecyl phenols, the weight ratio of (D) to (C) being less than 1, and the combined treat rate of said hydroxybenzoate(s), anhydride(s) and phenol(s) being in the range of 5 to 30, preferably 5 to 25, mass %.

The weight ratio of (D) to (C) is preferably in the range of 0.2 to 0.6, more preferably 0.25 to 0.5.

A second aspect of the invention is a method of preparing a trunk piston marine engine lubricating oil composition of TBN 20 to 60 for a medium-speed compression-ignited marine engine comprising blending (B), (C) and (D) with (A), each defined as in the first aspect of the invention.

A third aspect of the invention is a trunk piston marine engine lubricating oil composition of TBN 20 to 60 for a medium-speed four-stroke compression-ignited marine engine obtainable by the method of the second aspect of the invention.

A fourth aspect of the invention is the use of a combination of additives (D) and (C) as defined in the first aspect of the invention in a trunk piston marine lubricating oil composition of TBN 20 to 60 for a medium-speed compression-ignited marine engine also comprising (A) and (B) as defined in the first aspect of the invention, to improve asphaltene-handling during operation of said engine, fueled by a heavy-fuel oil, and its lubrication by the composition.

A fifth aspect of the invention is a method of operating a trunk piston medium-speed compression-ignited marine engine comprising (i) fueling the engine with a heavy fuel oil; and (ii) lubricating the crankcase of the engine with a lubricating oil composition of any of the first or third aspect of the invention.

In this specification, the following words and expressions, if and when used, have the meanings ascribed below:

"active ingredients" or "(a.i.)" refers to additive material that is not diluent or solvent;

"comprising" or any cognate word specifies the presence of stated features, steps, or integers or components, but does not preclude the presence or addition of one or more other features, steps, integers, components or groups thereof; the expressions "consists of" or "consists essentially of" or cognates may be embraced within "comprises" or cognates, wherein "consists essentially of" permits inclusion of substances not materially affecting the characteristics of the composition to which it applies;

"major amount" means 50 or more, preferably 60 or more, more preferably 70 or more, and most preferably 80 or more, mass % of a composition;

"minor amount" means less than 50, preferably less than 40, more preferably less than 30 and most preferably less than 20, mass % of a composition;

"TBN" means total base number as measured by ASTM D2896.

Furthermore in this specification:

"calcium content" is as measured by ASTM 4951;

"phosphorus content" is as measured by ASTM D5185;

"sulphated ash content" is as measured by ASTM D874;

"sulphur content" is as measured by ASTM D2622;

"KV100" means kinematic viscosity at 100° C. as measured by ASTM D445.

Also, it will be understood that various components used, essential as well as optimal and customary, may react under conditions of formulation, storage or use and that the invention also provides the product obtainable or obtained as a result of any such reaction.

Further, it is understood that any upper and lower quantity, range and ratio limits set forth herein may be independently combined.

DETAILED DESCRIPTION OF THE INVENTION

The features of the invention in its various aspects, if and where applicable, will now be discussed in more detail below.

Oil of Lubricating Viscosity (A)

The lubricating oils may range in viscosity from light distillate mineral oils to heavy lubricating oils. Generally, the viscosity of the oil ranges from 2 to 40 $mm^2$/sec, as measured at 100° C.

Natural oils include animal oils and vegetable oils (e.g., caster oil, lard oil); liquid petroleum oils and hydrorefined, solvent-treated or acid-treated mineral oils of the paraffinic, naphthenic and mixed paraffinic-naphthenic types. Oils of lubricating viscosity derived from coal or shale also serve as useful base oils.

Synthetic lubricating oils include hydrocarbon oils and halo-substituted hydrocarbon oils such as polymerized and interpolymerized olefins (e.g., polybutylenes, polypropylenes, propylene-isobutylene copolymers, chlorinated polybutylenes, poly(1-hexenes), poly(1-octenes), poly(1-decenes)); alkybenzenes (e.g., dodecylbenzenes, tetradecylbenzenes, dinonylbenzenes, di(2-ethylhexyl)benzenes); polyphenyls (e.g., biphenyls, terphenyls, alkylated polyphenols); and alkylated diphenyl ethers and alkylated diphenyl sulphides and derivative, analogs and homologs thereof.

Alkylene oxide polymers and interpolymers and derivatives thereof where the terminal hydroxyl groups have been modified by esterification, etherification, etc., constitute another class of known synthetic lubricating oils. These are exemplified by polyoxyalkylene polymers prepared by polymerization of ethylene oxide or propylene oxide, and the alkyl and aryl ethers of polyoxyalkylene polymers (e.g., methyl-polyiso-propylene glycol ether having a molecular weight of 1000 or diphenyl ether of poly-ethylene glycol having a molecular weight of 1000 to 1500); and mono- and polycarboxylic esters thereof, for example, the acetic acid esters, mixed $C_3$-$C_8$ fatty acid esters and $C_{13}$ Oxo acid diester of tetraethylene glycol.

Another suitable class of synthetic lubricating oils comprises the esters of dicarboxylic acids (e.g., phthalic acid, succinic acid, alkyl succinic acids and alkenyl succinic acids, maleic acid, azelaic acid, suberic acid, sebasic acid, fumaric acid, adipic acid, linoleic acid dimer, malonic acid, alkylmalonic acids, alkenyl malonic acids) with a variety of alcohols (e.g., butyl alcohol, hexyl alcohol, dodecyl alcohol, 2-ethylhexyl alcohol, ethylene glycol, diethylene glycol monoether, propylene glycol). Specific examples of such esters includes dibutyl adipate, di(2-ethylhexyl)sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the complex ester formed by reacting one mole of sebacic acid with two moles of tetraethylene glycol and two moles of 2-ethylhexanoic acid.

Esters useful as synthetic oils also include those made from $C_5$ to $C_{12}$ monocarboxylic acids and polyols and polyol esters such as neopentyl glycol, trimethylolpropane, pentaerythritol, dipentaerythritol and tripentaerythritol.

Silicon-based oils such as the polyalkyl-, polyaryl-, polyalkoxy- or polyaryloxysilicone oils and silicate oils comprise another useful class of synthetic lubricants; such oils include tetraethyl silicate, tetraisopropyl silicate, tetra-(2-ethylhexyl) silicate, tetra-(4-methyl-2-ethylhexyl)silicate, tetra-(p-tert-butyl-phenyl)silicate, hexa-(4-methyl-2-ethylhexyl)disiloxane, poly(methyl)siloxanes and poly(methylphenyl) siloxanes. Other synthetic lubricating oils include liquid esters of phosphorus-containing acids (e.g., tricresyl phosphate, trioctyl phosphate, diethyl ester of decylphosphonic acid) and polymeric tetrahydrofurans.

Unrefined, refined and re-refined oils can be used in lubricants of the present invention. Unrefined oils are those obtained directly from a natural or synthetic source without further purification treatment. For example, a shale oil obtained directly from retorting operations; petroleum oil obtained directly from distillation; or ester oil obtained directly from an esterification and used without further treatment would be an unrefined oil. Refined oils are similar to unrefined oils except that the oil is further treated in one or more purification steps to improve one or more properties. Many such purification techniques, such as distillation, solvent extraction, acid or base extraction, filtration and percolation are known to those skilled in the art. Re-refined oils are obtained by processes similar to those used to provide refined oils but begin with oil that has already been used in service. Such re-refined oils are also known as reclaimed or reprocessed oils and are often subjected to additional processing using techniques for removing spent additives and oil breakdown products.

The American Petroleum Institute (API) publication "Engine Oil Licensing and Certification System", Industry Services Department, Fourteenth Edition, December 1996, Addendum 1, December 1998 categorizes base stocks as follows:

a) Group I base stocks contain less than 90 percent saturates and/or greater than 0.03 percent sulphur and have a viscosity index greater than or equal to 80 and less than 120 using the test methods specified in Table E-1.

b) Group II base stocks contain greater than or equal to 90 percent saturates and less than or equal to 0.03 percent sulphur and have a viscosity index greater than or equal to 80 and less than 120 using the test methods specified in Table E-1.

c) Group III base stocks contain greater than or equal to 90 percent saturates and less than or equal to 0.03 percent sulphur and have a viscosity index greater than or equal to 120 using the test methods specified in Table E-1.

d) Group IV base stocks are polyalphaolefins (PAO).

e) Group V base stocks include all other base stocks not included in Group I, II, III, or IV.

Analytical Methods for Base Stock are tabulated below:

| PROPERTY | TEST METHOD |
|---|---|
| Saturates | ASTM D 2007 |
| Viscosity Index | ASTM D 2270 |
| Sulphur | ASTM D 2622 |
| | ASTM D 4294 |
| | ASTM D 4927 |
| | ASTM D 3120 |

The present invention embraces those of the above oils containing greater than or equal to 90% saturates and less than or equal to 0.03% sulphur as the oil of lubricating viscosity, eg Group II, III, IV or V. They also include basestocks derived from hydrocarbons synthesised by the Fischer-Tropsch process. In the Fischer-Tropsch process, synthesis gas containing carbon monoxide and hydrogen (or 'syngas') is first generated and then converted to hydrocarbons using a Fischer-Tropsch catalyst. These hydrocarbons typically require further processing in order to be useful as a base oil. For example, they may, by methods known in the art, be hydroisomerized; hydrocracked and hydroisomerized; dewaxed; or hydroisomerized and dewaxed. The syngas may, for example, be made from gas such as natural gas or other gaseous hydrocarbons by steam reforming, when the basestock may be referred to as gas-to-liquid ("GTL") base oil; or from gasification of biomass, when the basestock may be referred to as biomass-to-liquid ("BTL" or "BMTL") base oil; or from gasification of coal, when the basestock may be referred to as coal-to-liquid ("CTL") base oil.

Preferably, the oil of lubricating viscosity in this invention contains 50 mass % or more of said basestocks. It may contain 60, preferably 70, 80 or 90, mass % or more of said basestock or a mixture thereof. The oil of lubricating viscosity may be substantially all of said basestock or a mixture thereof.

It may be desirable, although not essential, to prepare one or more additive packages or concentrates comprising additives, whereby additives (B), (C) and (D) can be added simultaneously to the oil of lubricating viscosity (A) to form the TPEO.

The final formulations as a trunk piston engine oil may typically contain 30, preferably 10 to 28, more preferably 12 to 24, mass % of the additive package(s), the remainder being the oil of lubricating viscosity. The trunk piston engine oil has a compositional TBN (using ASTM D2896) of 20 to 60, such as, 30 to 55. For example, it may be 40 to 55 or 35 to 50. When the TBN is high, for example 45-55, the concentration of (B) may be higher. When the TBN is lower, for example 30 to below 45, the concentration of (B) may be lower.

The combined treat rate of additives (B), (C) and (D) contained in the lubricating oil composition is in the range of 5 to 30, preferably 5 to 25, more preferably 5 to 21, and most preferably 5 to 19, mass %.

Overbased Metal Detergent Additive (B)

A metal detergent is an additive based on so-called metal "soaps", that is metal salts of acidic organic compounds, sometimes referred to as surfactants. They generally comprise a polar head with a long hydrophobic tail. Overbased metal detergents comprise neutralized metal detergents as the outer layer of a metal base (e.g. carbonate) micelle, and may be provided by including large amounts of metal base by reacting an excess of a metal base, such as an oxide or hydroxide, with an acidic gas such as carbon dioxide.

In the present invention, overbased metal detergents (B) are overbased metal hydrocarbyl-substituted hydroxybenzoate, preferably hydrocarbyl-substituted salicylate, detergents.

"Hydrocarbyl" means a group or radical that contains carbon and hydrogen atoms and that is bonded to the remainder of the molecule via a carbon atom. It may contain hetero atoms, i.e. atoms other than carbon and hydrogen, provided they do not alter the essentially hydrocarbon nature and characteristics of the group. As examples of hydrocarbyl, there may be mentioned alkyl and alkenyl. The overbased metal hydrocarbyl-substituted hydroxybenzoate typically has the structure shown:

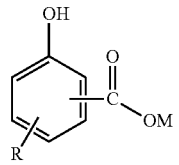

wherein R is a linear or branched aliphatic hydrocarbyl group, and more preferably an alkyl group, including straight- or branched-chain alkyl groups. There may be more than one R group attached to the benzene ring. M is an alkali metal (e.g. lithium, sodium or potassium) or alkaline earth metal (e.g. calcium, magnesium barium or strontium). Calcium or magnesium is preferred; calcium is especially preferred. The COOM group can be in the ortho, meta or para position with respect to the hydroxyl group; the ortho position is preferred. The R group can be in the ortho, meta or para position with respect to the hydroxyl group. When M is polyvalent, it is represented fractionally in the above formula.

Hydroxybenzoic acids are typically prepared by the carboxylation, by the Kolbe-Schmitt process, of phenoxides, and in that case, will generally be obtained (normally in a diluent) in admixture with uncarboxylated phenol. Hydroxybenzoic acids may be non-sulphurized or sulphurized, and may be chemically modified and/or contain additional substituents. Processes for sulphurizing a hydrocarbyl-substituted hydroxybenzoic acid are well known to those skilled in the art and are described, for example, in US 2007/0027057.

In hydrocarbyl-substituted hydroxybenzoic acids, the hydrocarbyl group is preferably alkyl (including straight- or branched-chain alkyl groups), and the alkyl groups advantageously contain 5 to 100, preferably 9 to 30, especially 14 to 24, carbon atoms.

The term "overbased" is generally used to describe metal detergents in which the ratio of the number of equivalents of the metal moiety to the number of equivalents of the acid moiety is greater than one. The term "low-based" is used to describe metal detergents in which the equivalent ratio of metal moiety to acid moiety is greater than 1, and up to about 2.

By an "overbased calcium salt of surfactants" is meant an overbased detergent in which the metal cations of the oil-insoluble metal salt are essentially calcium cations. Small amounts of other cations may be present in the oil-insoluble metal salt, but typically at least 80, more typically at least 90, for example at least 95, mole % of the cations in the oil-insoluble metal salt are calcium ions. Cations other than calcium may be derived, for example, from the use in the manufacture of the overbased detergent of a surfactant salt in which the cation is a metal other than calcium. Preferably, the metal salt of the surfactant is also calcium.

Carbonated overbased metal detergents typically comprise amorphous nanoparticles. Additionally, there are disclosures of nanoparticulate materials comprising carbonate in the crystalline calcite and vaterite forms.

The basicity of the detergents may be expressed as a total base number (TBN). A total base number is the amount of acid needed to neutralize all of the basicity of the overbased material. The TBN may be measured using ASTM standard D2896 or an equivalent procedure. The detergent may have a low TBN (i.e. a TBN of less than 50), a medium TBN (i.e. a TBN of 50 to 150) or a high TBN (i.e. a TBN of greater than 150, such as 150-500). Basicity Index may be used as a measure of basicity. Basicity Index is the molar ratio of total base to total soap in the overbased detergent. The Basicity Index of the detergent (A) in the invention is preferably in the range of 1 to 8, more preferably 3 to 8, such as 3 to 7, such as 3 to 6. The Basicity Index may for example be greater than 3.

Overbased metal hydrocarbyl-substituted hydroxybenzoates can be prepared by any of the techniques employed in the art. A general method is as follows:

1. Neutralisation of hydrocarbyl-substituted hydroxybenzoic acid with a molar excess of metallic base to produce a slightly overbased metal hydrocarbyl-substituted hydroxybenzoate complex in a solvent mixture consisting of a volatile hydrocarbon, an alcohol and water;
2. Carbonation to produce colloidally-dispersed metal carbonate followed by a post-reaction period;
3. Removal of residual solids that are not colloidally dispersed; and
4. Stripping to remove process solvents.

Overbased metal hydrocarbyl-substituted hydroxybenzoates can be made by either a batch or a continuous overbasing process.

Metal base (e.g. metal hydroxide, metal oxide or metal alkoxide), preferably lime (calcium hydroxide), may be charged in one or more stages. The charges may be equal or may differ, as may the carbon dioxide charges that follow them. When adding a further calcium hydroxide charge, the carbon dioxide treatment of the previous stage need not be complete. As carbonation proceeds, dissolved hydroxide is converted into colloidal carbonate particles dispersed in the mixture of volatile hydrocarbon solvent and non-volatile hydrocarbon oil.

Carbonation may be effected in one or more stages over a range of temperatures up to the reflux temperature of the alcohol promoters. Addition temperatures may be similar, or different, or may vary during each addition stage. Phases in which temperatures are raised, and optionally then reduced, may precede further carbonation steps.

The volatile hydrocarbon solvent of the reaction mixture is preferably a normally liquid aromatic hydrocarbon having a boiling point not greater than about 150° C. Aromatic hydrocarbons have been found to offer certain benefits, e.g. improved filtration rates, and examples of suitable solvents are toluene, xylene, and ethyl benzene.

The alkanol is preferably methanol although other alcohols such as ethanol can be used. Correct choice of the ratio of alkanol to hydrocarbon solvents, and the water content of the initial reaction mixture, are important to obtain the desired product.

Oil may be added to the reaction mixture; if so, suitable oils include hydrocarbon oils, particularly those of mineral origin. Oils which have viscosities of 15 to 30 $mm^2$/sec at 38° C. are very suitable.

After the final treatment with carbon dioxide, the reaction mixture is typically heated to an elevated temperature, e.g. above 130° C., to remove volatile materials (water and any remaining alkanol and hydrocarbon solvent). When the synthesis is complete, the raw product is hazy as a result of the presence of suspended sediments. It is clarified by, for example, filtration or centrifugation. These measures may be carried out before, or at an intermediate point, or after solvent removal.

The products are used as a diluent (or oil) dispersion. If the reaction mixture contains insufficient oil to retain an oil solution after removal of the volatiles, further oil should be added. This may occur before, or at an intermediate point, or after solvent removal.

Preferably, the diluent used for (B) comprises a basestock containing greater than or equal to 90% saturates and less than or equal to 0.03% sulphur. (B) may contain up to 20, 30, 40, 50, 60, 70, 80 or 90, mass % or more (such as all) of said basestock. An example of said basestock is a Group II basestock.

Polyisobutene Succinic Anhydride (C)

The anhydride may constitute at least 0.1 to 10, preferably 1 to 7, more preferably 1.5 to 5, mass % of the lubricating oil composition. Most preferably it constitutes 1 to 3 mass %.

The polyisobutene group has a number average molecular weight of 200 to 3000, preferably 350 to 1,000, most preferably 600 to 950.

General formulae of exemplary anhydrides may be depicted as

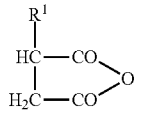

where $R^1$ represents a $C_8$ to $C_{400}$, such as $C_8$ to $C_{100}$ branched or linear polyalkenyl group.

Suitable hydrocarbons or polymers employed in the formation of the anhydrides of the present invention to generate the polyalkenyl moieties include homopolymers, interpolymers or lower molecular weight hydrocarbons. One family of such polymers comprise polymers of ethylene and/or at least one $C_3$ to $C_{28}$ alpha-olefin having the formula $H_2C{=}CHR^1$ wherein $R^1$ is straight or branched chain alkyl radical comprising 1 to 26 carbon atoms and wherein the polymer contains carbon-to-carbon unsaturation, preferably a high degree of terminal ethenylidene unsaturation. Preferably, such polymers comprise interpolymers of ethylene and at least one alpha-olefin of the above formula, wherein $R^1$ is alkyl of from 1 to 18 carbon atoms, and more preferably is alkyl of from 1 to 8 carbon atoms, and more preferably still of from 1 to 2 carbon atoms. Therefore, useful alpha-olefin monomers and comonomers include, for example, propylene, butene-1, hexene-1, octene-1, 4-methylpentene-1, decene-1, dodecene-1, tridecene-1, tetradecene-1, pentadecene-1, hexadecene-1, heptadecene-1, octadecene-1, nonadecene-1, and mixtures thereof (e.g., mixtures of propylene and butene-1, and the like). Exemplary of such polymers are propylene homopolymers, butene-1 homopolymers, ethylene-propylene copolymers, ethylene-butene-1 copolymers, propylene-butene copolymers and the like, wherein the polymer contains at least some terminal and/or internal unsaturation. Preferred polymers are unsaturated copolymers of ethylene and propylene and ethylene and butene-1. The interpolymers may contain a minor amount, e.g. 0.5 to 5 mole % of a $C_4$ to $C_{18}$ non-conjugated diolefin comonomer. However, it is preferred that the polymers comprise only alpha-olefin homopolymers, interpolymers of alpha-olefin comonomers and interpolymers of ethylene and alpha-olefin comonomers. The molar ethylene content of the polymers employed is preferably in the range of 0 to 80%, and more preferably 0 to 60%. When propylene and/or butene-1 are employed as comonomer(s) with ethylene, the ethylene content of such copolymers is most preferably between 15 and 50%, although higher or lower ethylene contents may be present.

These polymers may be prepared by polymerizing alpha-olefin monomer, or mixtures of alpha-olefin monomers, or mixtures comprising ethylene and at least one $C_3$ to $C_{28}$ alpha-olefin monomer, in the presence of a catalyst system comprising at least one metallocene (e.g., a cyclopentadienyl-transition metal compound) and an alumoxane compound. Using this process, a polymer in which 95% or more of the polymer chains possess terminal ethenylidene-type unsaturation can be provided. The percentage of polymer chains exhibiting terminal ethenylidene unsaturation may be determined by FTIR spectroscopic analysis, titration, or $C^{13}$ NMR. Interpolymers of this latter type may be characterized by the formula POLY-C($R^1$)═$CH_2$ wherein $R^1$ is $C_1$ to $C_{26}$ alkyl, preferably $C_1$ to $C_{18}$ alkyl, more preferably $C_1$ to $C_8$ alkyl, and most preferably $C_1$ to $C_2$ alkyl, (e.g., methyl or ethyl) and wherein POLY represents the polymer chain. The chain length of the $R^1$ alkyl group will vary depending on the comonomer(s) selected for use in the polymerization. A minor amount of the polymer chains can contain terminal ethenyl, i.e., vinyl, unsaturation, i.e. POLY-CH═$CH_2$, and a portion of the polymers can contain internal monounsaturation, e.g. POLY-CH═CH($R^1$), wherein $R^1$ is as defined above. These terminally-unsaturated interpolymers may be prepared by known metallocene chemistry and may also be prepared as described in U.S. Pat. Nos. 5,498,809; 5,663,130; 5,705,577; 5,814,715; 6,022,929 and 6,030,930.

Another useful class of polymers is polymers prepared by cationic polymerization of isobutene, styrene, and the like. Common polymers from this class include polyisobutenes obtained by polymerization of a $C_4$ refinery stream having a butene content of about 35 to about 75 mass %, and an isobutene content of about 30 to about 60 mass %, in the presence of a Lewis acid catalyst, such as aluminum trichloride or boron trifluoride. A preferred source of monomer for making poly-n-butenes is petroleum feedstreams such as Raffinate II. These feedstocks are disclosed in the art such as in U.S. Pat. No. 4,952,739. Polyisobutylene is a most preferred backbone of the present invention because it is readily available by cationic polymerization from butene streams (e.g., using $AlCl_3$ or $BF_3$ catalysts). Such polyisobutylenes generally contain residual unsaturation in amounts of about one ethylenic double bond per polymer chain, positioned along the chain. A preferred embodiment utilizes polyisobutylene prepared from a pure isobutylene stream or a Raffinate I stream to prepare reactive isobutylene polymers with terminal vinylidene olefins. Preferably, these polymers, referred to as highly reactive polyisobutylene (HR-PIB), have a terminal vinylidene content of at least 65%, e.g., 70%, more preferably at least 80%, most preferably, at least 85%. The preparation of such polymers is described, for example, in U.S. Pat. No. 4,152,499. HR-PIB is known and HR-PIB is commercially available under the tradenames Glissopal™ (from BASF) and Ultravis™ (from BP-Amoco).

Polyisobutylene polymers that may be employed are generally based on a hydrocarbon chain of from 400 to 3000. Methods for making polyisobutylene are known. Polyisobutylene can be functionalized by halogenation (e.g. chlorination), the thermal "ene" reaction, or by free radical grafting using a catalyst (e.g. peroxide), as described below.

To produce (B) the hydrocarbon or polymer backbone may be functionalized, with carboxylic anhydride-producing moieties selectively at sites of carbon-to-carbon unsaturation on the polymer or hydrocarbon chains, or randomly along chains using any of the three processes mentioned above or combinations thereof, in any sequence.

Processes for reacting polymeric hydrocarbons with unsaturated carboxylic, anhydrides and the preparation of derivatives from such compounds are disclosed in U.S. Pat. Nos. 3,087,936; 3,172,892; 3,215,707; 3,231,587; 3,272,746; 3,275,554; 3,381,022; 3,442,808; 3,565,804; 3,912,764; 4,110,349; 4,234,435; 5,777,025; 5,891,953; as well as EP 0 382 450 B1; CA-1,335,895 and GB-A-1,440,219. The polymer or hydrocarbon may be functionalized, with carboxylic acid anhydride moieties by reacting the polymer or hydrocarbon under conditions that result in the addition of functional moieties or agents, i.e., acid, anhydride, onto the polymer or hydrocarbon chains primarily at sites of carbon-to-carbon unsaturation (also referred to as ethylenic or olefinic unsaturation) using the halogen assisted functionalization (e.g. chlorination) process or the thermal "ene" reaction.

Selective functionalization can be accomplished by halogenating, e.g., chlorinating or brominating the unsaturated α-olefin polymer to about 1 to 8 mass %, preferably 3 to 7 mass % chlorine, or bromine, based on the weight of polymer or hydrocarbon, by passing the chlorine or bromine through the polymer at a temperature of 60 to 250° C., preferably 110 to 160° C., e.g., 120 to 140° C., for about 0.5 to 10, preferably 1 to 7 hours. The halogenated polymer or hydrocarbon (hereinafter backbone) is then reacted with sufficient monounsaturated reactant capable of adding the required number of functional moieties to the backbone, e.g., monounsaturated carboxylic reactant, at 100 to 250° C., usually about 180° C. to 235° C., for about 0.5 to 10, e.g., 3 to 8 hours, such that the product obtained will contain the desired number of moles of the monounsaturated carboxylic reactant per mole of the halogenated backbones. Alternatively, the backbone and the monounsaturated carboxylic reactant are mixed and heated while adding chlorine to the hot material.

While chlorination normally helps increase the reactivity of starting olefin polymers with monounsaturated functionalizing reactant, it is not necessary with some of the polymers or hydrocarbons contemplated for use in the present invention, particularly those preferred polymers or hydrocarbons which possess a high terminal bond content and reactivity. Preferably, therefore, the backbone and the monounsaturated functionality reactant, (carboxylic reactant), are contacted at elevated temperature to cause an initial thermal "ene" reaction to take place. Ene reactions are known.

The hydrocarbon or polymer backbone can be functionalized by random to attachment of functional moieties along the polymer chains by a variety of methods. For example, the polymer, in solution or in solid form, may be grafted with the monounsaturated carboxylic reactant, as described above, in the presence of a free-radical initiator. When performed in solution, the grafting takes place at an elevated temperature in the range of about 100 to 260° C., preferably 120 to 240° C. Preferably, free-radical initiated grafting would be accomplished in a mineral lubricating oil solution containing, e.g., 1 to 50 mass %, preferably 5 to 30 mass % polymer based on the initial total oil solution.

The free-radical initiators that may be used are peroxides, hydroperoxides, and azo compounds, preferably those that have a boiling point greater than about 100° C. and decompose thermally within the grafting temperature range to provide free-radicals. Representative of these free-radical initiators are azobutyronitrile, 2,5-dimethylhex-3-ene-2,5-bis-tertiary-butyl peroxide and dicumene peroxide. The initiator, when used, typically is used in an amount of between 0.005% and 1% by weight based on the weight of the reaction mixture solution. Typically, the aforesaid monounsaturated carboxylic reactant material and free-radical initiator are used in a weight ratio range of from about 1.0:1 to 30:1, preferably 3:1 to 6:1. The grafting is preferably carried out in an inert atmosphere, such as under nitrogen blanketing. The resulting grafted polymer is characterized by having carboxylic acid (or derivative) moieties randomly attached along the polymer chains: it being understood, of course, that some of the polymer chains remain ungrafted. The free radical grafting described above can be used for the other polymers and hydrocarbons of the present invention.

The preferred monounsaturated reactants that are used to functionalize the backbone comprise mono- and dicarboxylic acid material, i.e., acid, or acid derivative material, including (i) monounsaturated $C_4$ to $C_{10}$ dicarboxylic acid wherein (a) the carboxyl groups are vicinyl, (i.e., located on adjacent carbon atoms) and (b) at least one, preferably both, of said adjacent carbon atoms are part of said mono unsaturation; (ii) derivatives of (i) such as anhydrides or $C_1$ to $C_5$ alcohol derived mono- or diesters of (i); (iii) monounsaturated $C_3$ to $C_{10}$ monocarboxylic acid wherein the carbon-carbon double bond is conjugated with the carboxy group, i.e., of the structure —C═C—CO—; and (iv) derivatives of (iii) such as $C_1$ to $C_5$ alcohol derived mono- or diesters of (iii). Mixtures of monounsaturated carboxylic materials (i)-(iv) also may be used. Upon reaction with the backbone, the monounsaturation of the monounsaturated carboxylic reactant becomes saturated. Thus, for example, maleic anhydride becomes backbone-substituted succinic anhydride, and acrylic acid becomes backbone-substituted propionic acid. Exemplary of such monounsaturated carboxylic reactants are fumaric acid, itaconic acid, maleic acid, maleic anhydride, chloromaleic acid, chloromaleic anhydride, acrylic acid, methacrylic acid, crotonic acid, cinnamic acid, and lower alkyl (e.g., $C_1$ to $C_4$ alkyl) acid esters of the foregoing, e.g., methyl maleate, ethyl fumarate, and methyl fumarate.

To provide the required functionality, the monounsaturated carboxylic reactant, preferably maleic anhydride, typically will be used in an amount ranging from about equimolar amount to about 100 mass % excess, preferably 5 to 50 mass % excess, based on the moles of polymer or hydrocarbon. Unreacted excess monounsaturated carboxylic reactant can be removed from the final dispersant product by, for example, stripping, usually under vacuum, if required.

Phenolic Compound (D)

A characteristic structural feature of the phenolic compounds used in the invention is meta hydrocarbyl-substitution of the aromatic ring where the substituent is attached to the ring at its first (C1) carbon atom. This structural feature is not available by chemical alkyl phenol synthesis such as the Friedel-Crafts reaction of phenol with olefins. The latter typically gives mixtures of ortho and para alkyl phenols (but only around 1% of meta alkyl phenols), and where attachment of the alkyl group to the aromatic ring is at the second (C2) or higher carbon atom.

A second characteristic structural feature of the phenolic compounds used in the invention is that they are sterically unhindered, i.e. they lack tertiary alkyl groups in either of the 2 and 6 positions of the benzene ring relative to a hydroxyl group of the phenolic compound.

Phenolic compounds having the above structural features are, for example, derivable from widely-available and renewable raw materials, such as cashew nut shells. Such shells contain approximately 40% phenolic materials and potentially constitute a low-cost raw material for phenols. Technical cashew nut shell liquid ("Technical CNSL") is the liquid extracted by roasting the shells. Distilling technical CNSL gives rise to "cardanol"; and hydrogenation of cardanol gives rise to a material often referred to as "hydrogenated distilled cashew nut shell liquid."

Cardanol typically contains 3-pentadecylphenol (3%); 3-(8-pentadecenyl)phenol (34-36%); 3-(8,11-pentadecadienyl)phenol (21-22%); and 3-(8,11,14-pentadecatrienyl)phenol (40-41%), plus a small amount of 5-(pentadecyl)resorcinol (c. 10%), also referred to as cardol. Technical CNSL contains mainly cardanol plus some polymerized material. Cardanol may therefore be expressed as containing significant amounts of meta-linear 8-pentadecenyl substituted phenol, where the pentaecenyl group is attached to the aromatic ring at its first carbon atom (C1).

The present invention employs, as an additive, material where a major proportion, preferably all, of the phenol, contains functionalised material with a long linear saturated side chains. Such latter material is obtainable by hydrogenating cardanol, completely or partially, as mentioned above; to give 3-(pentadecyl)phenol, where the pentadecyl group is linear and is attached to the aromatic ring at its first carbon atom. It may constitute 50 or more, 60 or more, 70 or more, 80 or more, or 90 or more, mass % of additive compound (B). It may contain small quantities of 5-(pentadecyl)resorcinol.

The phenolic compounds may, for example, be represented by the general formula

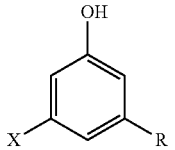

where R is a linear pentadecyl group attached to the aromatic nucleus at its C1 position and X is a hydrogen atom or hydroxyl group.

Suitably, the additive component (D) is present in an amount of 0.1 to 10, preferably 0.1 to 9.9, more preferably 0.1 to 6.9, and most preferably 0.1 to 2, mass % of the lubricant, based on the total mass of the lubricant.

The weight ratio of (D) to (C) is preferably in the range of 0.15 to 0.6, more preferably 0.20 to 0.55, even more preferably 0.25 to 0.52, and most preferably 0.25 to 0.5.

Co-Additives

The lubricating oil composition of the invention may comprise further additives, different from and additional (B), (C) and (D). Such additional additives may, for example include ashless dispersants, other metal detergents, anti-wear agents such as zinc dihydrocarbyl dithiophosphates, anti-oxidants and demulsifiers.

The following examples illustrate but in no way limit the invention.

EXAMPLES

Components

The following compounds were used:

(A) Oil of lubricating viscosity
An API Group II 600R basestock from Chevron (B) Detergents: (1) a 225BN Ca alkyl salicylate (alkyl=C14-18)
(2) a 350BN Ca alkyl salicylate (alkyl=C14-18)

(C) A polyisobutene succinic anhydride ("PIBSA") derived from a polyisobutene having a number average molecular weight of 950.

(D) 3-pentadecylphenol (Cardolite NC510 ex Sigma Aldrich)

Heavy Fuel Oil 150-F-RMK 380

Lubricants

Selections of the above components were blended to give a range of trunk piston marine engine lubricants. Some of the lubricants are examples of the invention; others are reference examples for comparison purposes. The compositions of the lubricants tested (when each contained HFO) are shown in the tables below under the "Results" heading. Each lubricant had a TBN of about 40.

Testing

Light Scattering

Test lubricants were evaluated for asphaltene dispersancy using light scattering according to the Focused Beam Reflectance Method ("FBRM"), which predicts asphaltene agglomeration and hence 'black sludge' formation.

The FBRM test method was disclosed at the $7^{th}$ International Symposium on Marine Engineering, Tokyo, 24-28 Oct. 2005, and was published in 'The Benefits of Salicylate Detergents in TPEO Applications with a Variety of Base Stocks', in the Conference Proceedings. Further details were disclosed at the CIMAC Congress, Vienna, 21-24 May 2007 and published in "Meeting the Challenge of New Base Fluids for the Lubrication of Medium Speed Marine Engines—An Additive Approach" in the Congress Proceedings. In the latter paper it is disclosed that by using the FBRM method it is possible to obtain quantitative results for asphaltene dispersancy that predict performance for lubricant systems based on base stocks containing greater than or less than 90% saturates, and greater than or less than 0.03% sulphur. The predictions of relative performance obtained from FBRM were confirmed by engine tests in marine diesel engines.

The FBRM probe contains fibre optic cables through which laser light travels to reach the probe tip. At the tip, an optic focuses the laser light to a small spot. The optic is rotated so that the focused beam scans a circular path between the window of the probe and the sample. As particles flow past the window, they intersect the scanning path, giving backscattered light from the individual particles.

The scanning laser beam travels much faster than the particles; this means that the particles are effectively stationary. As the focused beam reaches one edge of the particle the amount of backscattered light increases; the amount will decrease when the focused beam reaches the other edge of the particle.

The instrument measures the time of the increased backscatter. The time period of backscatter from one particle is multiplied by the scan speed and the result is a distance or chord length. A chord length is a straight line between any two points on the edge of a particle. This is represented as a chord length distribution, a graph of numbers of chord lengths (particles) measured as a function of the chord length dimensions in microns. As the measurements are performed in real time, the statistics of a distribution can be calculated and tracked. FBRM typically measures tens of thousands of chords per second, resulting in a robust number-by-chord length distribution. The method gives an absolute measure of the particle size distribution of the asphaltene particles.

The Focused beam Reflectance Probe (FBRM), model Lasentec D600L, was supplied by Mettler Toledo, Leicester, UK. The instrument was used in a configuration to give a particle size resolution of 1 mm to 1 mm. Data from FBRM can be presented in several ways. Studies have suggested that the average counts per second can be used as a quantitative determination of asphaltene dispersancy. This value is a function of both the average size and level of agglomerate. In this application, the average count rate (over the entire size range) was monitored using a measurement time of 1 second per sample.

The test lubricant formulations were heated to 60° C. and stirred at 400 rpm; when the temperature reached 60° C. the FBRM probe was inserted into the sample. An aliquot of heavy fuel oil (10% w/w) was introduced into the lubricant formulation under stirring using a four-blade stirrer (at 400 rpm). A value for the average counts per second was taken when the count rate had reached an equilibrium value (typically after 30 minutes).

Results

Light Scattering

The results of the FBRM tests are summarized in TABLE 1 and TABLE 2 below, where lower particle count indicates better performance.

TABLE 1

| Example | (C), mass % | (D), mass % | (D):(C) | Lasentec Counts |
|---|---|---|---|---|
| Comparative | 1.25 | 1.25 | 1.00 | 405.03 |
| 1 | 1.65 | 0.85 | 0.52 | 339.71 |
| 2 | 1.88 | 0.62 | 0.33 | 253.49 |
| 3 | 2.00 | 0.50 | 0.25 | 269.04 |

The salicylate content was 17.9 mass % from (B) (1). The results in the table show that performance is better as the (D):(C) ratio decreases. The examples of the invention (1-3) give better results than the comparative example.

As a control example, a salicylate-containing oil with no additive (C) and no additive (D) gave a Lasentec Count of 1062.58.

The salicylate content was at 11.9 and 3.8 mass % respectively from a combination of (B) (1) and (2).

TABLE 2

| Example | (C), mass % | (D), mass % | (D):(C) | Lasentec Counts |
|---|---|---|---|---|
| Comparative | 1.50 | 1.50 | 1.00 | 941.07 |
| 4 | 2.00 | 1.00 | 0.50 | 523.53 |
| 5 | 2.25 | 0.75 | 0.33 | 530.50 |
| 6 | 2.40 | 0.60 | 0.25 | 632.15 |

Again, the results in the table show that better performance is achieved as the (D):(C) ratio decreases. The examples of the invention (4-6) give better results than the comparative example.

In summary, the above results show that selection of a specific ratio of (D) to (C) provides a trunk piston marine engine oil composition exhibiting improved asphaltene dispersancy. In both tables, the Lasentec Count initially decreases as the (D):(C) is lowered, reaches a minimum, and then starts to increase as the ratio is further lowered.

What is claimed is:

1. A trunk piston marine engine lubricating oil composition having a TBN 20 to 60 mg KOH/g, for a medium-speed four-stroke compression-ignited marine engine, comprising or made by admixing:

(A) an oil of lubricating viscosity in a major amount containing greater than or equal to 90% saturates and less than or equal to 0.03% sulphur;

(B) a detergent additive, in a minor amount, comprising one or more overbased metal hydrocarbyl-substituted hydroxybenzoates;

(C) an additive, in an amount of 1 to 3 mass %, comprising one or more polyisobutene succinic anhydrides derived from polyisobutene having a number average molecular weight of 350 to 1000; and (D) an additive, in an amount of 0.1 to 2 mass %, comprising one or more sterically unhindered meta linear pentadecyl phenols, wherein the weight ratio of (D) to (C) is 0.2 to 0.55, and the combined treat rate of said hydroxybenzoate(s), anhydride(s) and phenol(s) is in the range of 5 to 19 mass %.

2. The composition of claim 1, wherein the oil of lubricating viscosity (A) comprises a Group II, III, IV or V basestock.

3. The composition of claim 2, wherein the oil of lubricating viscosity (A) comprises a Group II basestock.

4. The composition of claim 1, wherein the hydroxybenzoate(s) (B) is or are salicylates(s).

5. The composition of claim 4, wherein (B) comprises two salicylates, each having a different TBN.

6. The composition of claim 5, wherein (B) comprises two salicylates, each having a different TBN of greater than 200 mg KOH/g, as measured by ASTM D2896.

7. The composition of claim 4 where (B) is a single salicylate.

8. The composition of claim 7 wherein (B) is a single salicylate having a TBN of greater than 200 mg KOH/g, as measured by ASTM D2896.

9. The composition of claim 4, wherein the salicylate(s) is or are calcium salicylate(s).

10. The composition of claim 1, wherein (D) comprises hydrogenated distilled cashew nut shell liquid.

11. The composition of claim 10, wherein (D) comprises 3-pentadecylphenol.

12. A method of preparing a trunk piston marine engine lubricating oil composition of TBN 20 to 60 for a medium-speed compression-ignited marine engine comprising blending (A) an oil of lubricating viscosity in a major amount containing greater than or equal to 90% saturates and less than or equal to 0.03% sulphur;

(B) a detergent additive, in a minor amount, comprising one or more overbased metal hydrocarbyl-substituted hydroxybenzoates;

(C) an additive, in an amount of 1 to 3 mass %, comprising one or more polyisobutene succinic anhydrides derived from polyisobutene having a number average molecular we of 350 to 1000; and (D) an additive, in an amount of 0.1 to 2 mass %, comprising one or more sterically unhindered meta linear pentadecyl phenols, wherein the weight ratio of (D) to (C) is 0.2 to 0.55, and the combined treat rate of said hydroxybenzoate(s), anhydride(s) and phenol(s) is in the range of 5 to 19 mass %.

13. A trunk piston marine engine lubricating oil composition for a medium-speed four-stroke compression-ignited marine engine obtained by the method of claim 12.

14. A method of operating a trunk piston medium-speed compression-ignited marine engine comprising (i) fuelling the engine with a heavy fuel oil; and (ii) lubricating the crankcase of the engine with a lubricating oil composition having a TBN 20 to 60 mg KOH/g, comprising or made by admixing:

(A) an oil of lubricating viscosity in a major amount containing greater than or equal to 90% saturates and less than or equal to 0.03% sulphur;

(B) a detergent additive, in a minor amount, comprising one or more overbased metal hydrocarbyl-substituted hydroxybenzoates;

(C) an additive, in an amount of 1 to 3 mass %, comprising one or more polyisobutene succinic anhydrides derived from polyisobutene having a number average molecular weight of 350 to 1000; and (D) an additive, in an amount of 0.1 to 2 mass %, comprising one or more sterically unhindered meta linear pentadecyl phenols, wherein the weight ratio of (D) to (C) is 0.2 to 0.55, and the combined treat rate of said hydroxybenzoate(s), anhydride(s) and phenol(s) is in the range of 5 to 19 mass %.

* * * * *